United States Patent [19]

Strangfeld

[11] Patent Number: 4,557,000

[45] Date of Patent: Dec. 10, 1985

[54] TOILET-TANK DISCHARGE VALVE

[75] Inventor: Reiner Strangfeld, Bückeburg, Fed. Rep. of Germany

[73] Assignees: Georg Rost; Sohne Armaturenfabrik GmbH & Co. KG, both of Porta Westfalica Lerbeck, Fed. Rep. of Germany

[21] Appl. No.: 531,783

[22] Filed: Sep. 13, 1983

[30] Foreign Application Priority Data

Sep. 15, 1982 [EP] European Pat. Off. ..... 82108501.6

[51] Int. Cl.[4] ..... E03D 1/14; E03D 1/34

[52] U.S. Cl. ..... 4/324; 4/378; 4/410; 4/415; 251/25

[58] Field of Search ..... 4/324–327, 4/378, 392, 393, 405, 410–415, 249, 250, 407; 251/25, 38, 44

[56] References Cited

U.S. PATENT DOCUMENTS

| | | | |
|---|---|---|---|
| 3,958,281 | 5/1976 | Remmel | 4/327 |
| 4,032,997 | 7/1977 | Phripp et al. | 4/415 |
| 4,176,821 | 12/1979 | Strangfeld | 4/203 |
| 4,185,338 | 1/1980 | Bresnyan | 4/327 |

FOREIGN PATENT DOCUMENTS

| | | | |
|---|---|---|---|
| 3140033 | 10/1981 | Fed. Rep. of Germany | 4/415 |

*Primary Examiner*—Stephen Marcus
*Assistant Examiner*—Linda J. Sholl
*Attorney, Agent, or Firm*—Sprung Horn Kramer & Woods

[57] ABSTRACT

A toilet-tank discharge valve has a main-valve body that can be lifted off of its face, by release-activating an auxiliary valve with an activating mechanism, as a consequence of negative water balance in an associated discharge compartment. A supplementary auxiliary valve is associated with the discharge compartment and opens at least briefly as a result of discontinuance activation of the activating mechanism, producing a positive water balance in the discharge compartment until the main-valve body closes. A valve of this type, with an auxiliary valve, makes it possible to discontinue the flushing process ahead of time. A shift mechanism in the connection between the activating mechanism and the supplementary auxiliary valve shifts the supplementary auxiliary valve from whatever limiting position it happens to be in into the opposite limiting position in response to a discontinuance activation. This makes it possible for both release and discontinuation activation to be initiated with uniform pressure strokes. This not only makes the device easier to operate but also makes remote activation possible with simple devices.

15 Claims, 6 Drawing Figures

TOILET-TANK DISCHARGE VALVE

BACKGROUND OF THE INVENTION

The present invention relates to a toilet-tank discharge valve with a main-valve body that can be lifted off of its face by release-activating an auxiliary valve with an activating mechanism as a consequence of negative water balance in an associated discharge compartment.

A system of this type is known from German No. OS 2,609,138, wherein the top of the main-valve body constitutes the lower limit of a discharge compartment. A water channel with an auxiliary valve in it leads from the discharge compartment into the outlet of the tank. When the full tank is initially activated—release-activated, that is—the auxiliary valve opens. The water flowing out of the discharge compartment generates a negative water balance in it, lifting the main-valve body off of its face.

It has not as yet been possible with discharge valves of this type to discontinue the flushing process once it has been initiated, and every activation results in a complete discharge of the tank.

SUMMARY OF THE INVENTION

In consideration of the constantly increasing need to conserve water, the object of the present invention is to provide a toilet-tank discharge valve of the aforesaid type in which flushing can be discontinued, once initiated, by a second activation. This discontinuance activation is carried out with the existing activating mechanism.

This and other objects are achieved in accordance with the invention by a supplementary auxiliary valve which is associated with the discharge compartment.

The supplementary auxiliary valve, which opens at least briefly as the result of the discontinuance activation of the activating mechanism, produces a positive water balance in the discharge compartment in the sense of the closing of the main-valve body, the positive water balance being maintained until the main-valve body is completely closed.

This system makes it possible to discontinue flushing in advance of the completion thereof and is also easy to operate because the activating forces and strokes can be kept low and because discontinuance is activated in the same way as the release.

In one embodiment of the invention, since the supplementary auxiliary valve has a larger cross-section than the auxiliary valve, it opens as the result of a discontinuance activation and does not close before the auxiliary valve closes.

In this case it is practical to position a shift mechanism in the connection between the activating mechanism and the supplementary auxiliary valve so that a discontinuance activation will shift the supplementary auxiliary valve from whatever limiting position it happens to be in into the opposite limiting position.

It is of course also possible to basically open the supplementary auxiliary valve only briefly as the result of discontinuance activation and to simultaneously extensively restrict the flow through the auxiliary valve with a plug that maintains itself in position until the main-valve body finally closes. This conformation makes it possible to carry out both release activation and discontinuance activation with the same pressure stroke. This not only makes the device easier to operate but also makes it possible to adapt the mechanisms that have long been conventional and that generally operate only in one direction, for the purposes of remote activation.

In one embodiment of the invention the shift mechanism is a binary reduction mechanism with a control arm that determines the direction in which it moves by whatever limiting position it happens to be in, that is mounted in such a way as to rotate on a pivot that can be moved by the activating mechanism, and that has lever arms flexibly mounted on each end and another lever arm flexibly mounted in the middle, with limiting pins on the free end of each lever arm with which are associated fixed catches with an access flank by means of which they can be temporarily secured in position during the relative motion initiated by the pivot and accompanied by temporary flexible deformation of the associated levers. This type of binary reduction mechanism allows comparatively short activating strokes and, even in its unactivated position, can be shifted with especially low forces out of its limiting position. This design for a binary reduction mechanism is considered inventive in itself.

Some embodiments of the invention will now be described by way of example with reference to the drawings, in which

DETAILED DESCRIPTION OF THE INVENTION

Figure 1:
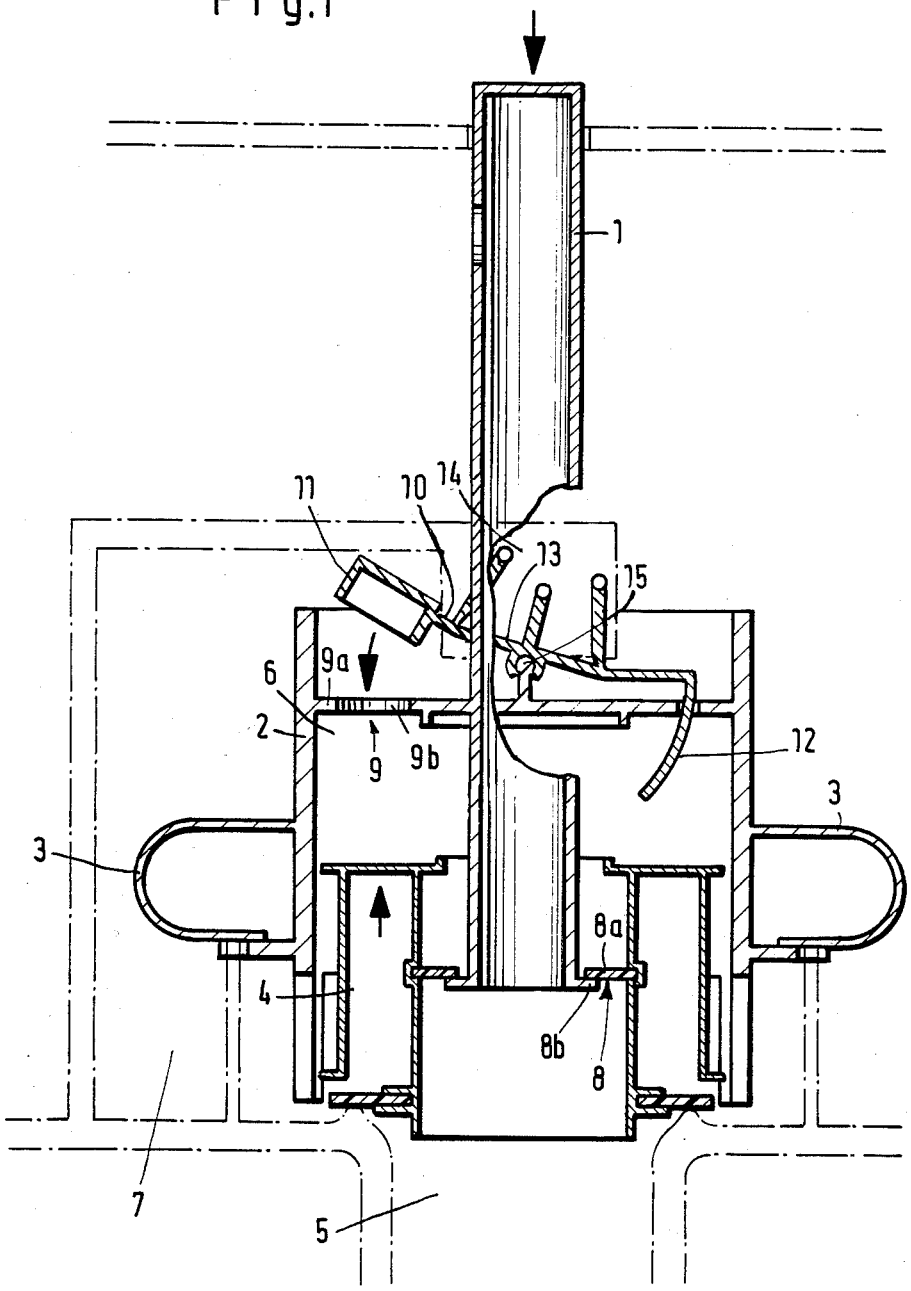
FIG. 1 is a schematic section through a discharge valve in the initial position according to the invention.
Figure 2:
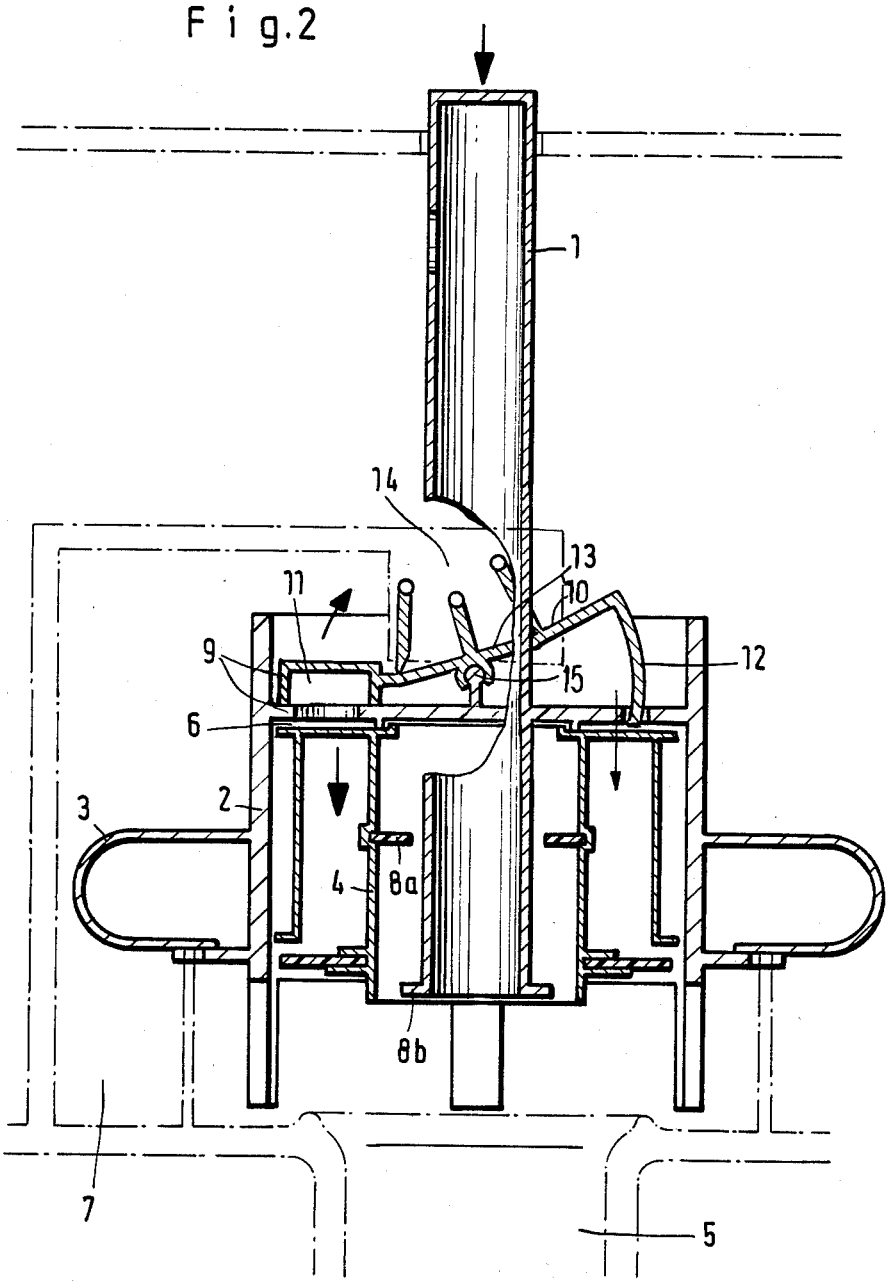
FIG. 2 illustrates the valve in FIG. 1 during the flushing process.

FIGS. 1 and 2 illustrate a discharge valve with a activating rod 1 projecting out of the top of the tank. Activating rod 1 is rigidly connected to a valve bell 2 that is supported on the floor of the tank by prestressed lateral springs 3. There is a main-valve body 4 inside valve bell 2 that can be lifted upwards and that blocks both the main valve at the bottom and auxiliary valve 8 in the middle when the tank is full and ready to flush (FIG. 1). The top of main-valve body 4 demarcates in conjunction with valve bell 2 a discharge compartment 6. Auxiliary valve 8, which blocks the water channel between discharge compartment 6 and tank outlet 5, consists of a gasket **8*a* positioned in main-valve body 4 and of a flange 8*b* at the bottom of activating rod 1**.

A supplementary auxiliary valve 9, consisting of a sealing float 11 that operates in conjunction with a perforation **9*b* through the wall 9*a*, is positioned in the upper wall 9*a* of discharge compartment 6. The free cross-section of supplementary auxiliary valve 9 is larger than that of auxiliary valve 8. Sealing float 11 is positioned on the left arm of a control lever 10 that has a pivot 15 that is rigidly connected to valve bell 2. On the right arm of lever 10 is a tappet 12 that penetrates into discharge compartment 6, and in the middle of the lever a control arm 13**.

Control arm 13, which moves in relation to a fixed control housing 14 every time the device is activated, constitutes in conjunction with that housing, a shift mechanism that can consist of a binary reduction mechanism like that to be described subsequently. The shift mechanism shifts control lever 10 out of whatever limiting position it happens to be in and into the opposite limiting position whenever the device is activated. Since control housing 14 does not impede control arm 13 in the unactivated state, control lever 10 will either remain in the limiting position it arrives at subsequent to activation of the device or will shift into the opposite limiting position depending on the direction in which forces are applied to it.

FIG. 1 illustrates the initial position of the discharge valve with the tank full and ready to flush. The main valve and the auxiliary valve 8 are closed. Since activating rod 1 is raised, supplementary auxiliary valve 9 is open and control arm 13 has assumed its right-hand limiting position. When the device is release-activated, control arm 13 will move in relation to control housing 14, which will shift it into its left-hand limiting position. Supplementary auxiliary valve 9 will close and, since auxiliary valve 8 will open simultaneously, the water balance in the discharge compartment will become negative. Main-valve body 4 will be lifted off of its seat and the flushing process will commence. These motions are indicated in FIG. 1 by the arrows.

Sealing float 11 can also be moved without compulsory control into its closure position by shift mechanism including elements 13 and 14. It must accordingly be designed so that it can be carried along in spite of its operating force by the flow imposed by auxiliary valve 8, which is also necessarily applied at supplementary auxiliary valve 9. This process will subsequently be described in greater detail.

FIG. 2 illustrates the same discharge valve subsequent to release activation and during the flushing process. Since the pressure difference acting on supplementary auxiliary valve 9 in the closure direction is maintained, sealing float 11 will remain closed in spite of its operating force. If no discontinuance activation occurs, main-valve body 4 will not close until the tank is empty. Water will then flow in through the supply valve and the level build up again. When the water level rises above sealing float 11, the latter's operating force will restore control lever 10 to the initial position illustrated in FIG. 1 and the tank will be ready to flush again.

With the state illustrated in FIG. 2 as a point of departure, discontinuance activation will again initiate the relative motion between control housing 14 and control arm 13. The latter will accordingly shift back into its right-hand limiting position. Supplementary auxiliary valve 9 will open and tappet 12 will simultaneously force main-valve body 4 downward. This is theoretically unnecessary, serving only to reinforce the closure motion, and can be restricted with no problem to the initial stretch of the closure stroke. Nevertheless, it does ensure that main-valve body 4 will enter the wake of the flushing water as it discharges and that its flotation force will be overcome more reliably by the downward-acting flow forces.

What is decisive for the prior closure of main-valve body 4 is the opening of supplementary auxiliary valve 9. Since the latter's free cross-section is larger than that of auxiliary valve 8, which is still open at this juncture, the necessary positive water balance will occur in discharge compartment 6. This balance will itself be maintained if auxiliary valve 8 and supplementary auxiliary valve 9 close simultaneously with the return stroke of activating rod 1. This is ensured not only by the larger cross-section of supplementary auxiliary valve 9 but also by the admittedly very slight but always present free cross-sections made available by the play space left between main-valve body 4 and valve bell 2. When the return stroke of activating rod 1 is complete, main-valve body 4 will finally close.

It is, however, also possible to do without the perforation **9*b* through the wall 9*a* of supplementary auxiliary valve 9, without, that is to say, its free cross-section. In this case, tappet 12, which can be moved into discharge compartment 6 by discontinuance activation, must make main-valve body 4 travel over its complete stroke. A more powerful tappet force will then be necessary because of the lack of hydraulic reinforcement to overcome the lift of main-valve body 4. It is also preferable to adopt shift mechanism including elements 13 and 14 to this design if the pivot 15 that supports control arm 13 is mounted rigidly and control housing 14** in such a way as to move when the device is activated.

Shift mechanism including elements 13 and 14 can be a special binary reduction mechanism for example, which will require a comparatively shorter activating stroke and will exert no forces on control lever 10 in the unactivated state. This mechanism will now be described with reference to FIGS. 3 and 4.

Figure 3:
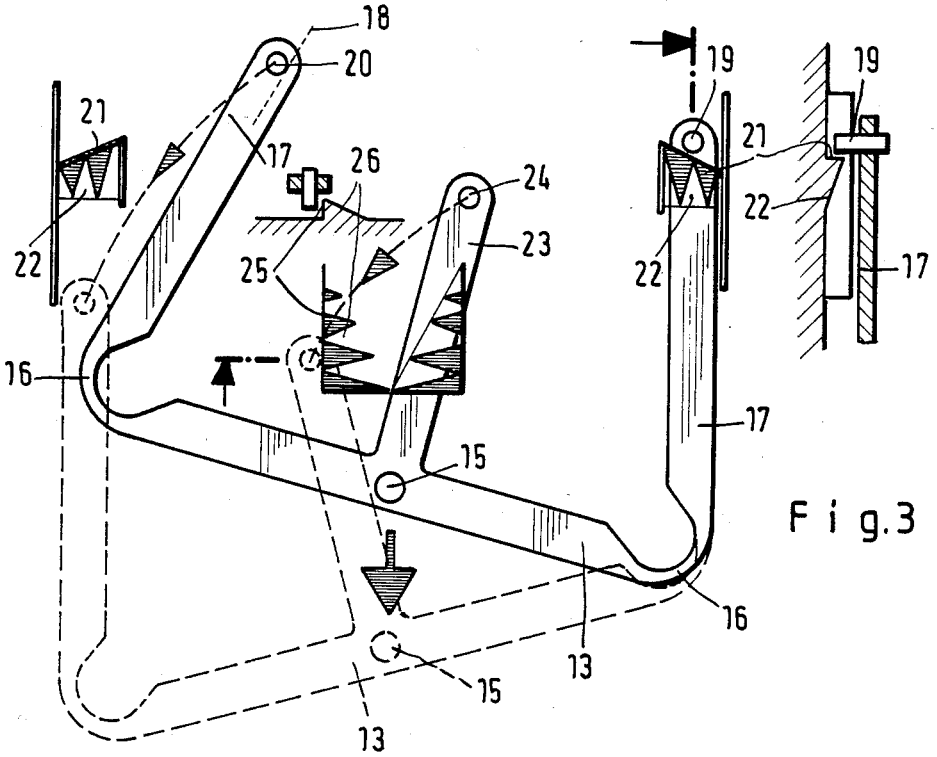
FIGS. 3 and 4 are schematic drawings of various operating phases of a binary reduction mechanism according to the invention.

In FIG. 3, the right-hand limiting position of symmetrically designed control arm 13' (which corresponds to the schematically represented arm 13 in FIGS. 1 & 2) is represented with the continuous lines. Its pivot 15' moves relative to the also symmetrical rigid control contours (which correspond to control housing 14 in FIGS. 1 & 2). Lever arms 17, one of which supports right-hand limiting pin 19 and the other left-hand limiting pin 20 at the top, are attached at the ends of control arm 13' at flexible joints 16. The limiting pins operate in conjunction with stationary catches 21 and their access flanks 22. At the upper end of intermediate arm 23 is a limiting pin 24 that operates in conjunction with stationary catches 25 and their access flanks 26. Since the arms with the limiting pins are elastic perpendicular to the plane of projection, the access flanks do not impede them.

When pivot 15' moves down in the direction indicated by the arrow in response to activation of the device, control arm 13' will pivot on its right-hand flexible joint because upward motion will be impeded at that point by the engagement of limiting pin 19 behind catch 21. On the way to the limiting position represented by the broken lines in FIG. 3, the limiting pin 24 on intermediate arm 23 will travel over the access flank 26 of limiting pin 24 and come to rest behind it.

Figure 4:
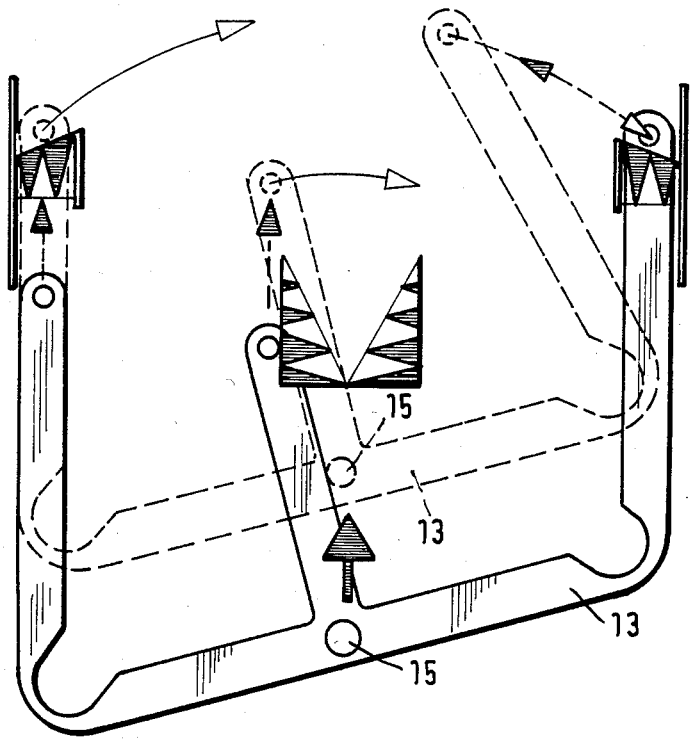

This limiting position is also the initial position for the subsequent return activation stroke and hence for pivot 15' represented by the continuous lines in FIG. 4. Limiting pin 24 will slip up behind catch 25 and lock control arm 13' into the left-hand limiting position. The right-hand limiting pin 19 will be released from catch 21 and spring back into its original position relative to control arm 13'. During the final phase of the return stroke, left-hand 20 will travel over access flank 22, the upper right limiting edge of which will take over the locking of the pivoting position before limiting pin 24 leaves catch 25. The return-stroke limiting position is illustrated in FIG. 4, the left limiting pin resting behind catch 21.

Because of the symmetrical design of the binary reduction mechanism just described, another double stroke will initiate the opposite motion, returning control arm 13' to its original initial position.

The limiting pins will not be impeded by the stationary control contours when the binary reduction mechanism is not activated. Control arm 13' can therefore be pivoted back into its original initial position without reinstating the double stroke by externally applied forces that only have to be powerful enough to overcome the bearing friction of pivot 15' as indicated by the blank arrows in FIG. 4.

The binary reduction mechanism can be re-designed for the present purpose in such a way that control arm 13' is pivoted into its opposite limiting position only by hydraulic forces when the device is release-activated. These hydraulic forces are effective to the extent that the flow initiated by the auxiliary valve when the device is release-activated is also necessarily applied at the supplementary auxiliary valve and moves the sealing float in the closure direction. In order to reinforce this closure motion, which must occur against the operating force of sealing float 11, a stationary catch 18 can be positioned as represented by the dotted line in FIG. 3. It will act on limiting pin 20 and introduce a leftwards pivot on the part of control arm 13'. A simplified shift mechanism of this type can accordingly, in comparison with the complete version of the binary reduction mechanism, do without the right-hand and intermediate control arms as well as the stationary control contours that operate in conjunction with them.

Figure 5:
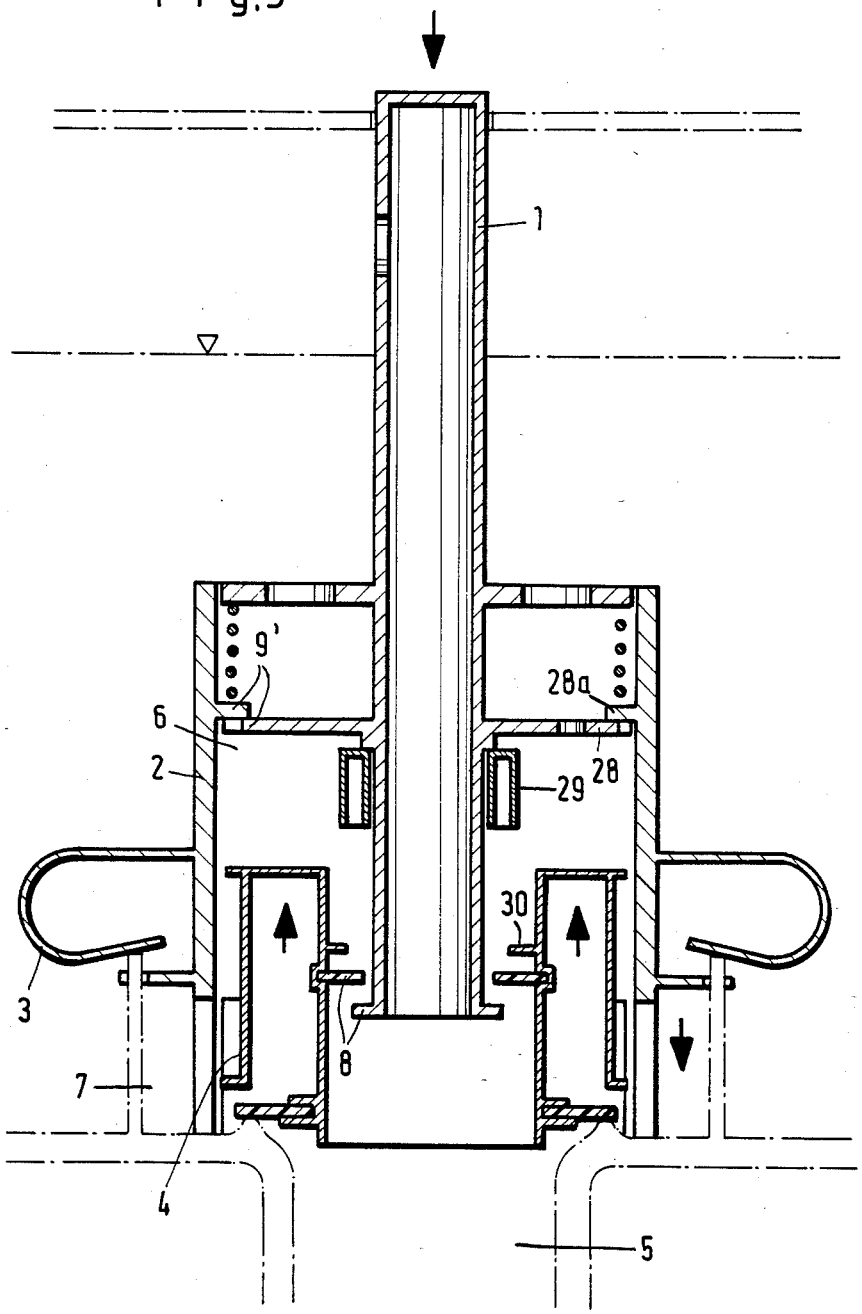
FIG. 5 is a schematic section through another embodiment of a discharge valve in the initial position.
Figure 6:
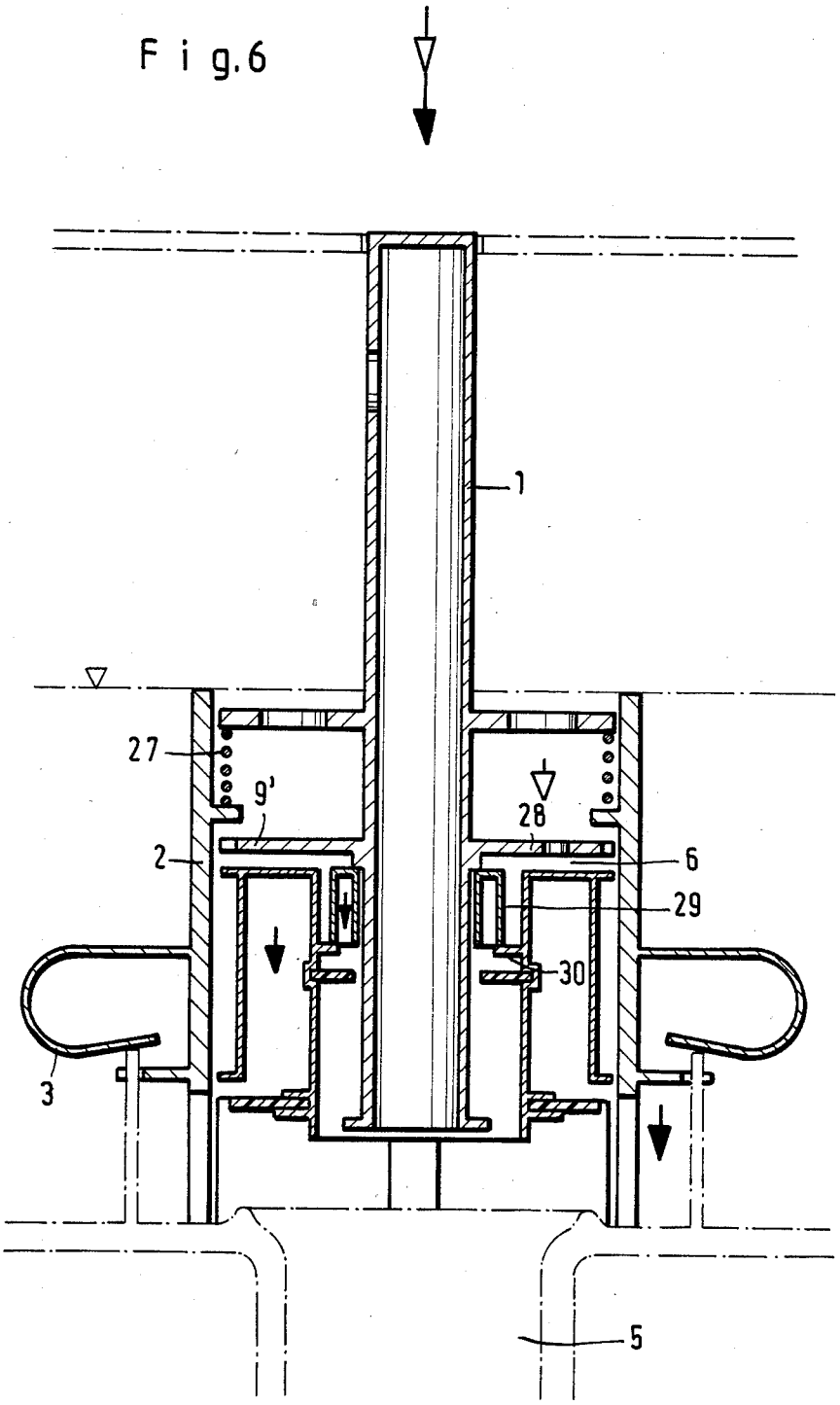
FIG. 6 illustrates the value in FIG. 5 during the flushing process.

In the embodiment of a discharge valve in accordance with the invention and illustrated in FIGS. 5 and 6, the discontinuance of the flushing process and the reinstatement of the readiness to flush is, although the design is comparable, achieved in a basically different way, with a shift mechanism in particular.

In this embodiment valve bell 2 and activating rod 1 are separate. They are, however, forced together by a compression spring 27 with prestressing that is more powerful than that of prestressed lateral springs 3. The supplementary auxiliary valve 9' leading into discharge compartment 6 consists of a flange 28 on activating rod 1 and of an annular shelf **28*a* inside valve bell 2 that operates in conjunction with the flange. An auxiliary float 29 is also positioned in the vicinity of discharge compartment 6 on activating rod 1. The outside diameter of the bottom of auxiliary float 29 is slightly longer than that of the interior shelf 30 in the central bore of main-valve body 4**.

The device is conventionally release activated. When, during release activation, only the restoration force of lateral springs 3 is overcome and not spring 27, supplementary auxiliary valve 9' will remain closed. The open auxiliary valve provides a negative water balance in discharge compartment 6, and main-valve body 4 opens. These motions are indicated by the arrows in FIG. 5.

FIG. 6 illustrates discontinuance activation, during which the restoration force of spring 27 is used to open supplementary auxiliary valve 9'. The water balance in discharge compartment 6 becomes positive and, in conjunction with the flow forces, which are reinforced in the closure direction, moves main-valve body 4 downward. Main-valve body 4 is followed by auxiliary float 29, which is pressed by hydraulic forces against the annular shelf 30 inside float piston 4, and thus blocks flow through the still open auxiliary valve 8. Thus, the positive water balance will be maintained until final closure of the discharge valve even when supplementary auxiliary valve 9' closes before auxiliary valve 8 during the return stroke of discontinuance activation. This is ensured again by the additional flow cross-sections between the outside diameter of main-valve body 4 and the interior surface of valve bell 2. These cross-sections are definitely larger than the comparatively narrow play space between auxiliary float 29 and activating rod 1.

With the final closure of the discharge valve, auxiliary valve 8 will also be closed. Auxiliary float 29 will, because of its lift, move up because the pressure drop initially affecting it can be compensated through its intermediate play space. The tank will accordingly be ready for the next release activation.

It will of course be evident that the embodiments described herein as examples of the invention represent only a fraction of its potential applications.

What is claimed is:

1. In a toilet-tank discharge valve having a main-valve body that is liftable off of its seat as a result of negative water balance in an associated discharge compartment effected, in response to the release-activating of an auxiliary valve by an activating mechanism, the improvement comprising: a supplementary auxiliary valve associated with the discharge compartment and responsive to a discontinuance activation of the activating mechanism to open at least briefly to produce a positive water balance in the discharge compartment until the main-valve body closes.

2. The toilet-tank discharge valve as in claim 1, wherein the supplementary auxiliary valve has a larger cross-section than the auxiliary valve and further comprising means coupling the supplementary auxiliary valve with the activating mechanism to close same no earlier than the auxiliary valve during the discontinuance-activation return stroke.

3. The toilet-tank discharge valve as in claim 2, wherein the coupling means comprises a shift mechanism for shifting the supplementary auxiliary valve from the present limiting position the opposite limiting position in response to a discontinuance actuating of the activating mechanism.

4. The toilet-tank discharge valve as in claim 3, wherein the shift mechanism comprises a control arm that is kept extensively free of friction in the unactivated state.

5. The toilet-tank discharge valve as in claim 3, wherein the shift mechanism comprises is a binary reduction mechanism with a control arm that determines the direction in which it moves by whatever limiting position it is in, means mounting the control arm for rotating on a pivot movable by the activating mechanism, wherein the control arm has lever arms flexibly mounted on each end and another lever arm flexibly mounted in the middle, with limiting pins on the free end of each lever arm and associated fixed catches with an access flank for temporarily securing the free end of each lever in position during the relative motion initiated by the pivot and accompanied by temporary flexible deformation of the associated levers.

6. The toilet-tank discharge valve as in claim 3, wherein the shift mechanism comprises a movable control lever having a sealing float on one end that controls the supplementary auxiliary valve.

7. The toilet-tank discharge valve as in claim 6, wherein the control lever has a tappet on the other end that is movable into the discharge compartment.

8. The toilet-tank discharge valve as in claim 6, wherein the shift mechanism comprises a binary reduction mechanism having only one lever arm that acts in the opening direction of the sealing float and control contours that operate in conjunction with the lever arm and wherein the sealing float is movable into its closure position by the flow that occurs subsequent to release activation.

9. The toilet-tank discharge valve as in claim 8, wherein the binary reduction mechanism further comprises a control contour for reinforcing the pivoting motion of the control lever on the shift mechanism that occurs subsequent to release activation.

10. The toilet-tank discharge valve as in claim 1, further comprising self-locking means for blocking the auxiliary valve until the main valve body closes to maintain the positive water balance in the discharge compartment produced by the at least brief opening of the supplementary auxiliary valve.

11. The toilet-tank discharge valve as in claim 10, wherein the activating mechanism includes an activating rod and the self-locking an auxiliary float narrowly positioned on the activating rod and in the upper position of the main-valve body rests on and blocks an annular shelf inside the main-valve body and moves upward along with the main-valve body subsequent to discontinuance activation.

12. The toilet-tank discharge valve as in claim 11, further comprising a valve bell with associated lateral springs and the supplementary auxiliary valve comprises a shelf on the inside surface of the valve bell and of a flange on the activating rod, a prestressed compression spring forcing the activating rod and the valve bell together, prestressed compression spring is prestressed to a force that is more powerful than that of the lateral springs of the valve bell.

13. The toilet-tank discharge valve as in claim 7, wherein the shift mechanism has a housing and the tappet is adjusted to effect a complete closure stroke of the main-valve body with the pivot that supports the control arm being stationary while the housing for the shift mechanism is movable by the activating mechanism.

14. The toilet-tank discharge valve as in claim 4, wherein the shift mechanism comprises is a binary reduction mechanism including said control arm which determines the direction in which it moves by whatever limiting position it is in, means mounting the control arm for rotating on a pivot movable by the activating mechanism, wherein the control arm has lever arms flexibly mounted on each end and another lever arm flexibly mounted in the middle, with limiting pins on the free end of each lever arm and associated fixed catches with an access flank for temporarily securing the free end of each lever in position during the relative motion initiated by the pivot and accompanied by temporary flexible deformation of the associated levers.

15. In a toilet-tank discharge valve having a main-valve body that is liftable off of its seat as a result of negative water balance in an associated discharge compartment effected, in response to the release-activating of an auxiliary valve by an activating mechanism, the improvement comprising: a supplementary auxiliary valve associated with the discharge compartment for producing a positive water balance in the discharge compartment until the main-valve body closes and a shift mechanism for coupling the supplementary auxiliary valve with the activating mechanism comprising is a binary reduction mechanism with a control arm that determines the direction in which it moves by whatever limiting position it is in, means mounting the control arm for rotating on a pivot movable by the activating mechanism, wherein the control arm has lever arms flexibly mounted on each end and another lever arm flexibly mounted in the middle, with limiting pins on the free end of each lever arm and associated fixed catches with an access flank for temporarily securing the free end of each lever in position during the relative motion initiated by the pivot and accompanied by temporary flexible deformation of the associated levers.

* * * * *